United States Patent [19]

Bower

[11] 3,944,206

[45] Mar. 16, 1976

[54] DELEAVER FOR CONTINUOUS BUSINESS FORMS

[75] Inventor: Kenneth W. Bower, Des Plaines, Ill.

[73] Assignee: Uarco Incorporated, Barrington, Ill.

[22] Filed: Sept. 30, 1974

[21] Appl. No.: 510,486

[52] U.S. Cl. ..... 270/52.5

[51] Int. Cl.[2] ..... B65H 41/00

[58] Field of Search ..... 270/52.5; 226/195, 108, 226/111, 117

[56] References Cited

UNITED STATES PATENTS

| | | | |
|---|---|---|---|
| 3,514,094 | 5/1970 | Absler | 270/52.5 |
| 3,570,736 | 3/1971 | Skiba | 226/195 |

*Primary Examiner*—Edgar S. Burr
*Assistant Examiner*—A. Heinz
*Attorney, Agent, or Firm*—Wegner, Stellman, McCord, Wiles & Wood

[57] ABSTRACT

An improved deleaver for separating the plies of multiple-ply, continuous business forms stationery assemblies with or without interleaved carbon plies. The deleaver includes an input end and an output end having a plurality of ply-receiving pockets. Intermediate the output end and the input end is a first driving device for engaging the continuous business forms assembly along a path of stationery travel to drive the same from the input end to the output end. Located forwardly of the drive means is a pinfeed device for engaging the assembly and forwardly of the pinfeed assembly is an adjustable drag device. The pinfeed device includes a non-positive drive that tends to drive the stationery along the path faster than the rate at which the stationery is driven by the drive means and, due to the effect of the drag device, operates in bucking relation therewith to produce smooth deleaving at all points in a deleaving run. Also disclosed is a deleaver having a positive drive for stationery driving components including timing belts and a unique hold-down roller assembly for cooperating with driving rollers forwardly of each of the pockets in the output end.

12 Claims, 5 Drawing Figures

10
12
14
16
18
20
22
24
26
28
30
32
62
P 10
32
34
36
38
40
42
46
48
50
52
54
56
58
60
62
64
66
74
90
92
100
102
3
3

DELEAVER FOR CONTINUOUS BUSINESS FORMS

BACKGROUND OF THE INVENTION

This invention relates to deleavers for separating the plies of multiple-ply, continuous business froms stationery assemblies. The most relevant prior art known to the applicant is U.S. Pat. No. 3,514,094 to Absler et al.

With the increasing use of continuous business forms assemblies in a variety of business operations due to the efficiency provided thereby, there has been a corresponding increase in the use of mechanized apparatus for performing various processing operations on such assemblies. A typical type of such apparatus is a so-called "deleaver" which is employed for the purpose of separating multiple-ply, continuous business forms assemblies into individual plies and for removing interleaved carbon transfer material located between stationery plies if such is used.

In the most basic sense, a deleaver includes an input end whereat a continuous business forms assembly typically folded in a zig-zag stack, is located. The form is fed through the deleaver to an output end which may be defined by a plurality of pockets each for receiving a designated ply or plies of the assembly. Various means are employed for driving the continuous business forms assembly from the input end to the output end. Frequently, pinfeed devices which engage control punched margins typically found on such forms are employed. In addition, where forms having interleaved carbon are employed, carbon takeup reels, generally equal in number to the number of pockets less one, are associated with all but the last pocket for winding up the interleaved carbon and thereby drawing the stationery through the deleaver.

Such devices do not always operate consistently to provide smooth deleaving. For example, because pinfeed drives tend to push the form through the apparatus, by reason of the tendency of the form, when not under tension, to reassume the typical zig-zag folded shape, the various plies of the same may not enter the pockets and refold smoothly. Similarly, because as a carbon takeup reel becomes loaded, its effective diameter increases, the rate at which the form is pulled through the apparatus will steadily increase from the beginning to the end of the run with the consequence that such carbon takeup devices tend to buck other feeding devices driven at a uniform rate from start to finish during the deleaving process. Such bucking can also interfere with uniform refolding of the individual plies within their associated pocket.

SUMMARY OF THE INVENTION

It is the principal object of the invention to provide a new and improved deleaver for continuous business forms stationery assemblies. More specifically, it is an object of the invention to provide such a deleaver wherein smooth operation with uniform refolding is virtually universally obtainable throughout a deleaving run even when the assembly to be deleaved includes interleaved carbon plies.

An exemplary embodiment achieves the foregoing objects in a structure including a frame having an input end and an output end defined by a plurality of individual plyreceiving pockets. The frame also includes means defining a path of stationery travel between the input end and the output end and the drive means are located along such path for driving the stationery along the path. Forwardly of the drive means and along the path is a pinfeed device for engaging the control punched margins of forms when such are present. The pinfeed device is driven by a non-positive drive, preferably in the form of a drive system having a friction clutch, in such a way that the pinfeed device would always tend to drive the form along the path of stationery travel at a rate greater than the rate at which the stationery would travel if driven by the above mentioned drive means alone throughout the entire run.

Forwardly of the pinfeed device is a drag device which is operable to place tension upon the form as it proceeds from the input end to the pinfeed device. Consequently, the drag device and the pinfeed device are in bucking relation with the latter serving to preclude the pinfeed device from driving at its intended rate of speed by reason of the non-positive drive. This results in the form being pulled through the deleaver under uniform tension from start to finish of a run by the drive device to cause uniform refolding.

According to one embodiment of the invention, the drive means includes one or more carbon takeup reels, one associated with each of the pockets save for that pocket most remote from the input end along the path of stationery travel. The carbon takeup reels are positively driven and to this end, timing belts are employed. The use of positive driving by means of timing belts, as opposed to non-positive drives such as V-belts, also promotes uniform refolding of the individual plies in the associated pocket.

The drive means also includes a plurality of driven rollers along the stationery path, each located just forwardly of an associated one of the pockets. Like the carbon reels, the rollers are positively driven by means of timing belts, again, to provide uniform refolding from the start to the finish of a run.

In a highly preferred embodiment of the invention, one or more hold-down roller assemblies are employed in connection with one or more of the above mentioned rollers for compressively sandwiching the stationery between the hold-down roller assembly and the drive roller. Means are provided whereby the degree of compression provided by the hold-down assembly may be varied.

Other objects and advantages will become apparent from the following specification taken in connection with the accompanying drawings.

DESCRIPTION OF THE PREFERRED EMBODIMENT

Figure 1:
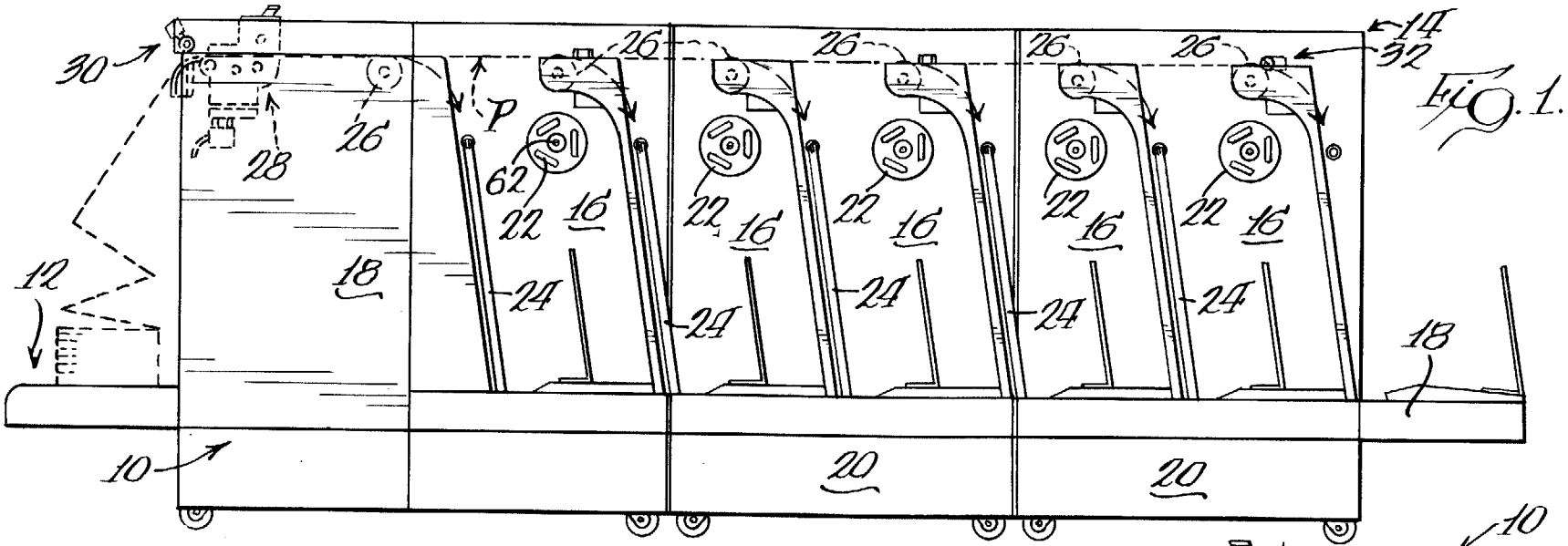
FIG. 1 is a side elevation of a deleaver made according to the invention.
Figure 2:
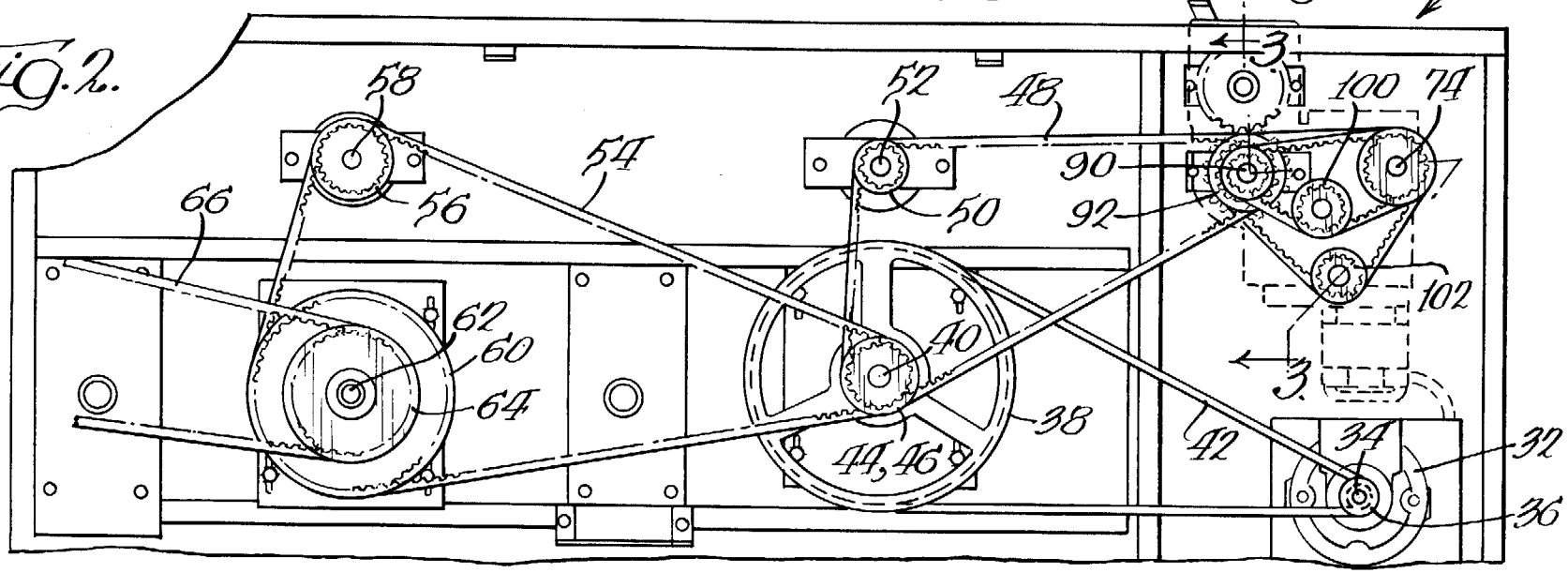
FIG. 2 is an enlarged, somewhat fragmentary view of the deleaver from the side opposite the side illustrated in FIG. 1.

An exemplary embodiment of a deleaver made according to the invention is illustrated in FIGS. 1 and 2 and is seen to include a frame, generally designated 10, comprised of plural structural members (not numbered) appropriately interconnected according to good engineering practice as well as various sheet metal panels, also not numbered. The frame 10 includes an input end, generally designated 12, which may be defined by a shelf or the like on which a continuous business forms stationery assembly, typically in a zig-zag folded stack, may be placed prior to the initiation of a deleaving operation. The frame 10 also includes an output end, generally designated 14, at which the deleaved forms may be removed following a deleaving operation. The output end 14 includes a plurality of pockets 16 and a shelf 18 which receive corresponding ones of the plies of the form being deleaved. For example, and with reference to FIG. 1, the leftmost pocket 16 will receive the lowermost ply of the assembly being deleaved, while the shelf 18 will receive the uppermost ply or plies of the form being deleaved assuming the form consists of six or more plies and is being deleaved on the deleaver illustrated in FIG. 1 which has five of the pockets 16.

Preferably, the frame 10 is made up of one or more modules. For example, an infeed module 18 may be employed and includes the input end 12 and one pocket 16. Other identical modules 20 having two pockets 16 may or may not be employed depending upon the desired capacity of the deleaver.

Various means to be described in greater detail hereinafter define a path of stationery travel shown in dotted lines and designated P form the input end 12 of the deleaver to the various pockets 16 and the shelf 18.

A drive means for driving the stationery along the path P includes a plurality of carbon takeup reels 22, one for each pocket. Of course, the carbon takeup reels provide a driving action only when a form having interleaved carbon is used. Each pocket 16 is also provided with a foldable carbon turning bar, shown in FIG. 1 in an unused position. Further details of the carbon turning bar may be ascertained by reference to the commonly assigned, copending application of Bower et al., Ser. No. 426,454, entitled "Deleaver For Continuous Business Forms Assemblies," filed Dec. 20, 1973.

Also forming part of the drive means for driving the stationery along the path P, are a plurality of rollers one for each of the pockets 16 and one for the shelf 18. The rollers are designated 26 and are adapted to engage the undersurface of the lowermost ply of the assembly as it passes the respective position of the rollers 26. Thus, the rollers 26 and/or the carbon takeup reels 22 constitute a drive means for driving the forms along the path P, which drive means are located forwardly of the output end 14 of the deleaver along the path P of stationery travel, i.e., forwardly along the path P with reference to the refolding surfaces of the pockets 16 and the shelf 18 as is well known.

The deleaver also includes a pinfeed assembly, generally designated 28, which has a plurality of pins for impaling the holes typically found in control punched margins on the forms to be deleaved if the forms are provided with such. The pinfeed assembly 28 is described in greater detail in the commonly assigned, copending application of Jennings et al., entitled "Powered Adjustable Trimmer Construction," Ser. No. 426,452, filed Dec. 20, 1973, the details of which are herein incorporated by reference.

Located forwardly along the path P of the pinfeed device 28, is an adjustable drag device, generally designated 30, to be described in greater detail hereinafter. The drag device 30 engages business forms traveling along the path P for the purpose of producing a drag thereon. The general construction is completed by the use of one or more hold-down roller assemblies, generally designated 32, and associated with corresponding ones of the rollers 26 to compressively sandwich a continuous business forms assembly against the rollers 26. The hold-down roller assemblies 32 will be described in greater detail hereinafter.

Referring now to FIG. 2, suitably mounted in the frame 10 is a motor 32 having a rotary output shaft 34 mounting a sheave 36. A sheave 38 is mounted on a suitably journalled shaft 40 and a belt 42 is trained about the sheaves 36 and 38 to establish a driving connection. Unlike the belts to be described hereinafter, the belt 42 may be of any desired construction and, according to one embodiment, is a so-called "poly V-belt."

The shaft 40 also mounts for rotation therewith first and second sheaves 44 and 46, only one of which can be seen. One of the sheaves 44 and 46 cooperates with a timing belt 48 to drive a sheave 50, which in turn drives a shaft 52. The shaft 52 in turn drives the leftmost roller 26 as seen in FIG. 1.

As will be seen, the timing belt 48 is also used to direct rotary power to the pinfeed device 28 as will be described in greater detail hereinafter.

The other of the sheaves 44 and 46, via a V-belt 54, directs rotary motion to a sheave 56 which in turn drives a shaft 58. The shaft 58 in turn drives the second roller 26 from the left.

The timing belt 54 is also trained about a sheave 60 for driving a shaft 62. The shaft 62 mounts the leftmost carbon takeup reel 22 and, accordingly, the latter will be driven when the shaft 62 is rotated. Also mounted on the shaft 62 is a sheave 64 having a timing belt 66 trained thereabout. The timing belt 66 extends to an arrangement of sheaves and shafts corresponding to the arrangement of the sheaves 56, 60 and 64 and shafts 58 and 62 to drive the next roller 26 and carbon takeup reel 22 and the arrangement is further duplicated as need be to provide motive power for all of the carbon takeup reels 22 and the rollers 26.

It is to be particularly observed that timing belts such as the timing belts 48, 54 and 66 are employed to insure positive drive of the rollers 26 and the carbon takeup reels 22. Other forms of positive drive, such as gears or chains, could be employed, but timing belts are preferred for economy purposes. It is to be understood that other drive systems which, in ordinary usage, may be considered somewhat positive, such as V-belts, are not contemplated and, in fact, are to be avoided so that the pinfeed device 28, the carbon takeup reels 22 and the drive rollers 26 are all driven positively with respect to each other to produce the optimum refolding and smooth deleaving accomplished by the invention.

Figure 3:
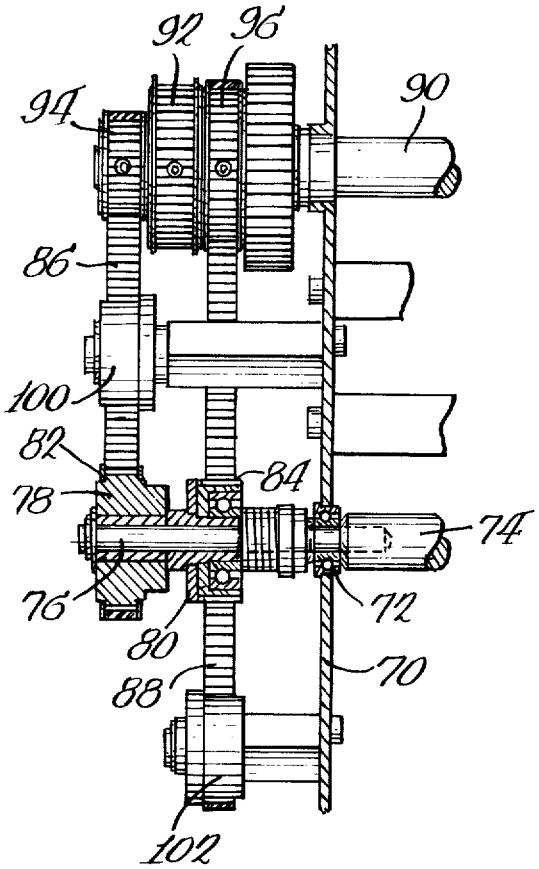
FIG. 3 is a sectional view taken approximately along the line 3—3 in FIG. 2.

Turning now to FIGS. 2 and 3, the manner in which the pinfeed device 28 is driven will be described in greater detail. With reference specifically to FIG. 3, a side plate 70 constituting a portion of the frame 10 mounts a bearing 72 for journalling a shaft 74 forming part of the pinfeed device 28. The shaft 74 provides motive force for the pins (not shown) as can be easily ascertained by reference to the aforementioned copending application. The shaft 74 includes a leftward extension in the form of a stub shaft 76 and the extreme left-hand end thereof, as viewed in FIG. 3, mounts a one-way clutch 78 of conventional construction. Intermediate the one-way clutch 78 and the plate 70 is a conventional friction clutch 80. As will be seen, the shaft 74, when the deleaver is in use, will be driven in a counterclockwise direction as seen in FIG. 2, and the arrangement of the one-way clutch 78 is such that when the input thereto is maintained stationary, assuming no resistance to rotation is provided by other components of the drive system, the shaft 74 may be freely rotated in the counterclockwise direction but will be held against movement in a clockwise direction.

The exteriors of both the one-way clutch 78 and the friction clutch 80 are provided with teeth 82 and 84 respectively for driving cooperation with timing belts 86 and 88 respectively.

The side plate 70 also journals a shaft 90 which is employed to drive a trimmer forming part of the pinfeed device 28 as described in greater detail in the aforementioned copending application. Mounted on the shaft 90 is a sheave 92 and the timing belt 48, as seen in FIG. 2, is trained thereabout. Also mounted on the shaft 90 for rotation therewith is a sheave 94 and a sheave 96, the sheave 94 being of smaller diameter than the sheave 96. The belt 86 is trained about the sheave 94 as well as an idler 100, while the belt 88 is trained about the sheave 96 and an idler 102.

As can be seen in FIG. 3, the pitch diameters of the clutches 78 and 80 are approximately the same, while a considerable difference in the pitch diameter of the sheaves 94 and 96 exists. Consequently, the driving of the shaft 94 via only the belt 86 and the one-way clutch 78 will be at a lesser rate than the driving of the shaft 74 via only the friction clutch 80, the belt 88 and the sheave 96. Consequently, during operation, the clutch 78 will always be overrunning by reason of the more rapid drive rate of the shaft 74 through the friction clutch 80.

While precise ratios of various driven components including the carbon takeup reels and the rollers 26 do not form a part of the instant invention, the relative rates of drive of these components relative to each other is of substantial consequence.

Those skilled in the art will recognize that when a stationery assembly having interleaved carbon is being deleaved, by reason of the positive driving of the carbon takeup reels 22, the fastest rate of stationery travel will occur just prior to the end of a deleaving run when the effective driving diameter of the carbon takeup reels 22 has been increased by reason of their accumulating carbon thereon. One skilled in the art will similarly recognize that the slowest speed during a deleaving run will be that at start-up when the effective driving diameter of the carbon takeup reels 22 will be at a minimum be reason of no carbon being accumulated thereon.

The selection of gear ratios is such that if the shaft 74 were only driven through the one-way clutch 78, the pins associated therewith would always drive the form at a rate less than the minimum rate mentioned above. At the same time, the selection is such that if the shaft 74 were driven only through the friction clutch 80 and there were no slippage in the connection by reason of the presence of the clutch 80, the pins associated with the shaft 74 would always be driven at the rate equal to or greater than the above mentioned maximum. Moreover, the rollers 26 are always driven at a rate approximately equal to or greater than the above mentioned maximum. Finally, it is generally preferable to drive the first and last rollers 26, i.e., those shown at the left and right, respectively, in FIG. 1, at a more rapid rate than the remainder.

One optimum arrangement is illustrated in the following Table wherein the base speed of the apparatus is selected as that of the carbon takeup reels 22 and no slippage in the friction clutch 80 is assumed.

RELATIVE SURFACE SPEED OF COMPONENTS

| Component | Start of Run (No Carbon on Reels) | End of Run of 1842 Feet of Carbon |
|---|---|---|
| Carbon Takeup Reels | Base Speed | Base Speed |
| Stationery Drive Rollers | 61% faster | 1% slower |
| First Stationery Drive Roller | 164% faster | 62% faster |
| Last Stationery Drive Roller | 94% faster | 19% faster |
| Pinfeed - One-Way Clutch | 11% slower | 45% slower |
| Pinfeed - Friction Clutch | 64% faster | 1% faster |

The foregoing Table illustrates that the pinfeed device 28 would substantially overfeed the carbon takeup reels at the beginning of the run and would be nominally overfeeding at the end of the run. However, as mentioned previously, the drag device 30 is located forwardly of the pinfeed device 28 along the path P of stationery travel and when adjusted properly to place drag on the form as it travels through the path P will cause the friction clutch 80 to slip. The drag produced is chosen to essentially balance the driving forces produced by the pinfeed device 28 with those produced by the carbon takeup reels and/or the stationery drive rollers so that the forms intermediate the pinfeed device 28 and the carbon takeup reels and/or stationery drive rollers are under slight tension. Consequently, the forms are "lightly" pulled through the pinfeed device 28 by either the carbon takeup reels 22 if a form having interleaved carbon is being deleaved with some assistance provided by the rollers 26 or, if a carbonless form is being deleaved, entirely by the rollers 26.

Figure 4:
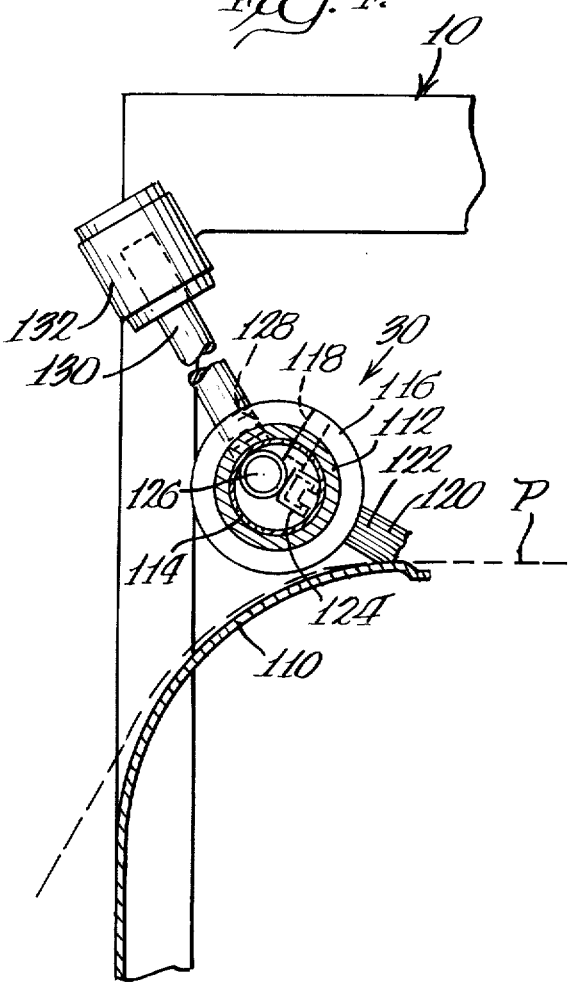
FIG. 4 is an enlarged, fragmentary view of a drag device employed in the invention with parts shown in section for clarity.

With reference to FIG. 4, the drag device 30 will be described in greater detail. Specifically, the left-hand end of the frame 10 mounts a curved plate 110 which defines a portion of the path P of stationery travel is illustrated.

A male collar 112, shown in section, is secured by any suitable means to one of the deleaver sides and journals an elongated, split tube 114 as well as a female clamping collar 116. By means of a pin 118, the split tube 114 is affixed to the female collar 116. At the opposite side of the deleaver a further collar secured to the side thereof journals the opposite end of the split tube 114 so that the latter extends across the entire deleaver.

A brush 120 has a series of bristles 122 extending through the slit in the tube 114 along the entire length thereof and a backing member 124 within the interior of the tube 114. A wooden dowel 126 is forced into the tube 114 in abutting relation with the backing 124 to firmly secure the brush 120 in the position illustrated in FIG. 4.

The female collar 116 is provided with a threaded bore 128 at a location overlying the male collar 112. A threaded shaft 130 is threadably received within the bore 128 and mounts a handle 132 at one end thereof. As a result of the foregoing construction, the threaded shaft 130 may be brought to bear against the male bushing 112 to affix the assemblage, including the brush 120, the slit tube 114, the female bushing 116, and the threaded shaft 130 in any desired position of rotation about the axis provided by the male bushing 112. Stated another way, by loosening the shaft 130 within the bore 128 through appropriate manipulation of the knob 134, and rotating the latter about the elongated axis of the slit tube 114, the attitude of the bristles relative to the path P may be selectively varied to vary the degree of force applied to stationery traveling along the path by the bristle 122, and thus produce an adjustable drag effect.

As a result of the foregoing structure of the drag device 30, the same may be appropriately adjusted to balance out the driving force that would be applied by the pinfeed device to the business forms being deleaved by causing the clutch 80 to slip. In other words, the drive provided to the pinfeed device through the clutch 80 and the drag device 30 buck each other so that other drive components including the carbon takeup reels 22 and the rollers 26 provide all feeding action resulting in uniform tension of the continuous business forms assembly throughout the deleaving process which materially assists in refolding and smooth operation.

Moreover, because the clutch 80 will attempt to drive the pinfeed device associated with the shaft 74 at a rate that would cause the forms to overfeed, and such overfeeding is resisted by the drag device 30, friction in the pinfeed device is virtually eliminated. That is, throughout the entire deleaving operation, when the pinfeed device is being employed in connection with forms having control punched margins, the drive components are not pulling the assembly against internal friction within the drive for the pinfeed device.

As is well known, many business forms in use presently do not employ interleaved carbon strips. Accordingly, when such forms are being deleaved, the sole driving force of the forms through the apparatus is applied by the rollers 26 since the carbon takeup reels 22 will not be employed. Typically, hold-down roller assemblies have been employed in connection with such rollers to insure good contact therewith to obtain proper feeding. However, even with such hold-down devices as have been conventionally used, smooth feeding has not been universally obtained.

Figure 5:
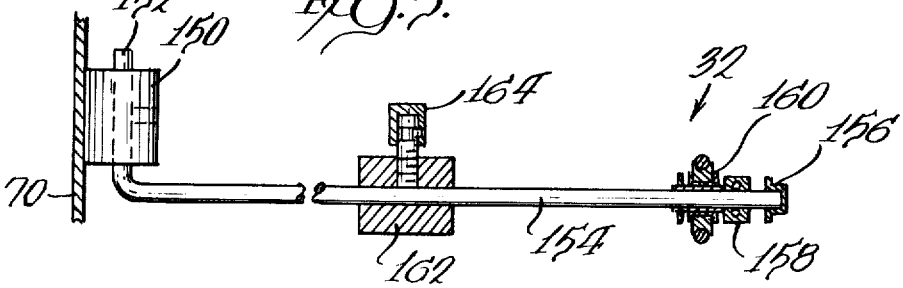
FIG. 5 is a view of a hold-down roller assembly with parts shown in section.

FIG. 5 illustrates a hold-down roller assembly, previously identified under the general designation 32, in greater detail. In particular, the side plate 70 of the deleaver mounts a suitable bracket 150 for receiving an offset end 152 of a shaft 154 to journal the same about a generally horizontal axis. At the end of the shaft 154 remote from the end 152, a force-fit retaining cap 156 is provided and inwardly of the cap 156 is a bushing 158 having an internal diameter just slightly less than the diameter of the shaft 154. Consequently, the bushing 158 may be moved longitudinally on the shaft 154 but friction will cause the same to remain in any position at which it is located.

The bushing 158 mounts a hold-down roller element 160 which is adapted to engage the upper surface of a continuous business forms assembly as it is being deleaved.

Intermediate the roller element 160 and the bracket 150, the shaft 154 slidably mounts a weight 162 having a screw clamp 164 associated therewith. By loosening the screw clamp 164, the position of the weight 162 on the shaft 154 may be selectively adjusted. By tightening the screw shaft 164 at a desired position of adjustment, the weight 162 may be made to remain in a particular position.

It will be recognized that the roller element 160 is mounted in a cantilever fashion by reason of the bracket 150 and that the degree of compression exerted by the roller element 160 against the form and an underlying one of the rollers 26 would be varied in accordance with the position of the weight 152 on the shaft 154. When a greater degree of compressive force is desired, the weight 162 may be moved toward the cap 156 while when a lesser degree of compressive force is required, the weight 162 may be moved towards the bracket 150. In so varying the force, the friction between the rollers 26, which it will be recalled, form part of a drive means for the form, and the form is varied according to such compression. Thus, through suitable adjustment an optimum degree of compression resulting in optimum feeding and refolding can be achieved.

If desired, the location of the roller element 160 may be adjusted as necessary simply by sliding the bushing 158 along the shaft 154 to a desired position.

With the adjustment thus provided in the hold-down roller assembly, smooth feeding of the forms to be deleaved and optimum refolding can be obtained for carbonless forms or, for that matter, when forms not having control punched margins are deleaved. In such a case, through suitable adjusting of the hold-down roller assembly and the drag device 30, uniform tension can again be achieved.

From the foregoing, it will be apparent that a deleaver made according to the invention provides substantially improved performance over those heretofore known regardless of whether used in deleaving carbon or carbonless forms or forms with or without control punched margins.

I claim:

1. In a deleaver for separating the plies of multiple-ply, continuous business forms stationery assemblies, the combination comprising: frame means having an input end for receiving the continuous business forms assembly and an output end for separately receiving individual plies of the continuous business forms assembly and including means defining a path of stationery travel from said input end to said output end; means along said path for engaging the continuous business forms assembly for driving the continuous business forms assembly along said path; a pinfeed device located forwardly of said driving means for cooperating with control punched margins on a continuous business forms assembly, said pinfeed device including means defining a non-positive drive for tending to cause said pinfeed device to drive the continuous business forms assembly along said path at a rate greater than the rate at which said driving means will drive the continuous business forms assembly along said path and a drag device for engaging a continuous business forms assembly, said drag device being located on said path and between said input end and said pinfeed device whereby smooth movement of a continuous business forms assembly along said path for varying rates of velocity thereof produced by said driving means is achieved through balancing of the driving force imparted to the continuous business forms assembly by said pinfeed device with drag on said continuous business forms assembly produced by said drag device.

2. The deleaver of claim 1 wherein said drag device is adjustable to produce varying degrees of drag on a continuous business forms assembly.

3. The deleaver of claim 2 wherein said drag device comprises a brush-like structure having bristles for engaging a continuous business forms assembly being driven along said path and means for adjusting the location of said bristles relative to said path to adjust the degree of drag placed on said continuous business forms assembly.

4. A deleaver according to claim 1 especially adapted for the separation of a multiple-ply, continuous business forms assembly having interleaved carbon plies wherein said output end includes at least two pockets and further including at least one carbon takeup reel, said driving means including said carbon takeup reel.

5. A deleaver according to claim 1 wherein said output end includes at least two pockets for receiving different plies of a multiple-ply continuous business forms assembly and wherein said drive means comprise a roller associated with each of said pockets for engaging associated plies of the continuous business forms assembly.

6. A deleaver according to claim 1 wherein said non-positive drive means includes a friction clutch.

7. A deleaver according to claim 1 wherein said pinfeed device includes a further drive having a one-way clutch, said further drive tending to cause said pinfeed device to drive the continuous business forms assembly along said path at a rate lesser than the rate at which said drive means will drive the continuous business forms assembly along said path, said one-way clutch being arranged to permit said non-positive drive means, said drive means and said drag device to substantially determine the rate at which said pinfeed device drives the continuous business forms assembly along said path.

8. A deleaver according to claim 1 wherein said pinfeed device includes a rotary shaft and said non-positive drive means includes a motor having a rotary output shaft and first means including a friction clutch drivingly interconnecting said output shaft with said pinfeed shaft; and further including second means drivingly interconnecting said output shaft and said pinfeed shaft including a one-way clutch and means for reducing the speed at which said pinfeed shaft is driven by said second means through said one-way clutch so that said pinfeed shaft is driven at a lesser rate by said second means through said one-way clutch than by said first means through said friction clutch, said speed reducing means further being such that the rate at which said pinfeed shaft is driven by said second means will be such that continuous business forms would be driven along said path by said driving means at a rate greater than that by said pinfeed device if said pinfeed device were driven solely by said second means.

9. A deleaver according to claim 1 wherein said output end includes a plurality of at least two pockets for receiving different plies of a continuous business forms assembly and wherein said drive means includes a plurality of rollers, one for each pocket, and located on said path; and means for rotating said rollers to drive stationery into the associated pockets, said means for rotating said rollers including a driven rotary shaft and a positive drive system interconnecting said driven shaft and said rollers.

10. A deleaver according to claim 9 wherein said positive drive system includes timing belts.

11. A deleaver according to claim 1 especially adapted for the separation of multiple-ply, continuous business forms assemblies having interleaved carbon plies wherein said output end includes at least two pockets for receiving associated stationery plies and further including at least one carbon takeup reel, said driving means including said carbon takeup reel; and means for positively driving said carbon takeup reel.

12. A deleaver according to claim 11 wherein said means for positively driving said carbon takeup reel comprise a driven rotary output shaft and a timing belt interconnecting said driven shaft and said carbon takeup reel.

* * * * *